US012459616B2

(12) United States Patent
Broinowski

(10) Patent No.: US 12,459,616 B2
(45) **Date of Patent: *Nov. 4, 2025**

(54) MARINE DUCTED PROPELLER MASS FLUX PROPULSION SYSTEM

(71) Applicant: Stefan Broinowski, Lausanne (CH)

(72) Inventor: Stefan Broinowski, Lausanne (CH)

(73) Assignee: Stefan Broinowski, Lausanne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/527,925

(22) Filed: Nov. 16, 2021

(65) Prior Publication Data

US 2022/0073177 A1 Mar. 10, 2022

Related U.S. Application Data

(63) Continuation of application No. 16/827,287, filed on Mar. 23, 2020, now abandoned, which is a (Continued)

(51) Int. Cl.

| | |
|---|---|
| ***B63H 11/08*** | (2006.01) |
| ***B63H 11/113*** | (2006.01) |
| ***F01N 3/02*** | (2006.01) |

(52) U.S. Cl.

CPC ..... *B63H 11/08* (2013.01); *B63H 11/113* (2013.01); *F01N 3/0205* (2013.01); *B63H 2011/081* (2013.01); *F01N 2590/02* (2013.01)

(58) Field of Classification Search

CPC ..... B63H 11/00; B63H 11/02; B63H 11/04; B63H 11/08; B63H 11/103; B63H 11/113; B63H 2011/00; B63H 2011/02; B63H 2011/04; B63H 2011/43; B63H 2011/08; B63H 2011/081; B63H 2011/082; F01N 3/0205; F01N 2590/02; F01N 13/004

(Continued)

(56) References Cited

U.S. PATENT DOCUMENTS 4,718,870 A * 1/1988 Watts ..... F04F 5/461 60/221
6,027,383 A * 2/2000 Broinowski ..... B63H 11/113 440/38

(Continued)

FOREIGN PATENT DOCUMENTS

JP H01273788 A 11/1989

*Primary Examiner* — Daniel V Venne
(74) *Attorney, Agent, or Firm* — Armstrong Teasdale LLP

(57) ABSTRACT

A marine ducted propeller mass flux propulsion system that comprises: an intake section; an impeller/confusor/stator section; a discharge section; a passage extending from an intake opening of the intake section to an outlet of the discharge section, the passage having a length and an axial cross-sectional area, the passage capable of creating a flow path for a water stream on a volumetric basis; and a plurality of internal working parts, the plurality of internal working parts being at least partially accommodated within the passage, wherein the axial cross-sectional area of the passage is increased and decreased throughout the length of the passage to accommodate a volumetric mass of the plurality of the internal working parts while maintaining a constant water volume from the intake opening of the intake section to the outlet of the discharge section.

17 Claims, 10 Drawing Sheets

Related U.S. Application Data continuation of application No. 15/854,437, filed on Dec. 26, 2017, now Pat. No. 10,597,129, which is a continuation-in-part of application No. 14/776,989, filed as application No. PCT/US2014/030864 on Mar. 17, 2014, now abandoned.

(60) Provisional application No. 61/799,274, filed on Mar. 15, 2013.

(58) Field of Classification Search
USPC ..... 440/38, 40–43, 47, 49, 53, 61 S
See application file for complete search history.

(56) References Cited

U.S. PATENT DOCUMENTS 6,692,318 B2 * 2/2004 McBride ..... B63H 11/08
440/38
7,238,067 B2 * 7/2007 O'Connor ..... B63H 11/103
440/38

* cited by examiner

MARINE DUCTED PROPELLER MASS FLUX PROPULSION SYSTEM

CROSS-REFERENCE TO RELATED APPLICATIONS

This application is a continuation of and claims priority to U.S. Continuation application Ser. No. 16/827,287, filed on Mar. 23, 2020 and now abandoned, which claims priority to U.S. continuation in part application Ser. No. 15/854,437, filed on Dec. 26, 2017 and now U.S. Pat. No. 10,597,129, which claims priority to U.S. patent application Ser. No. 14/776,989 filed on Sep. 15, 2015, which is a U.S. National Stage Application of PCT/US2014/30864, filed on Mar. 17, 2014, which claims priority to U.S. Provisional Pat. Application No. 61/799,274, filed on Mar. 15, 2013, entitled "MARINE DUCTED PROPELLER JET PROPULSION SYSTEM," all of which are hereby incorporated by reference.

FIELD OF THE DISCLOSURE

The present disclosure relates to exemplary embodiments of a marine ducted propeller mass flux propulsion apparatus, and more particularly, to exemplary embodiments of an impeller assembly and ducted design for a marine ducted propeller mass flux propulsion unit.

BACKGROUND INFORMATION

The use of traditional jet propulsion devices for marine craft is well known technology. Jet propulsion has many advantages over the simple propeller, particularly in terms of shallow water navigation and maneuverability, though jet propulsion energy consumption is much less efficient than traditional propeller systems. However, widespread acceptance of jet propulsion for marine craft has not occurred because of certain common problems associated with marine jet propulsion. For example, marine jet propulsion can pose significant design application issues because of uncertain performance over a wide range of speeds, water depth, sea conditions, excess water pickup at the jet propulsion unit inlet that may cause balling and others, etc.

Cavitation is another common problem. Cavitation represents an uneven pressure load (net positive suction head) on the impeller. Cavitation can be produced by excessive radial acceleration of the fluid, excess swirl and aerated turbulence of the fluid column, and pressure changes that cause unintentional partial vaporization of the fluid throughput associated with a vacuum produced by impeller action.

Accordingly, it would be desirable to design a jet like propulsion unit for marine vessels with the propulsion efficiency of a propeller where each feature synergistically works together to provide for a constant solid, unaerated column of water even at high output and where the water throughput is neither turbulent nor swirling in order to eliminate cavitation and pressure changes effects. Furthermore, the unit should have synergetic vessel application with maximum flexibility to cope with the entire speed range of the marine vessel and varied loading on the unit of its prime mover without producing the above-mentioned balling and cavitation effects.

SUMMARY

In one implementation, the disclosed technology can be a marine ducted propeller mass flux propulsion system comprising: an intake section; an impeller/confusor/stator section; a discharge section; a passage extending from an intake opening of the intake section to an outlet of the discharge section, the passage having a length and an axial cross-sectional area, the passage capable of creating a flow path for a water stream on a volumetric basis; and a plurality of internal working parts, the plurality of internal working parts being at least partially accommodated within the passage volumetrically, wherein the axial cross-sectional area of the passage is increased and decreased throughout the length of the passage to accommodate a volumetric mass of the plurality of the internal working parts while maintaining a constant water volume as steady-state flow from the intake opening of the intake section to the outlet of the discharge section.

In some implementations, the plurality of internal working parts can include at least a portion of one of a drive shaft, straightener intake flow guide vanes, pre-swirl stator vanes, an impeller housing, an impeller hub, impeller blades, a confusor/stator housing, an interchangeable blade assembly including interchangeable blades and stator vanes, a steering shaft, spoke vanes, and flow guide vanes.

In some implementations, a confusor/stator housing of the impeller stator section and an upper steering nozzle of the discharge section can form an exit radius at a transition point between the confusor/stator housing and the upper steering nozzle which allows for a reduction of turbulent flow for the water stream.

In some implementations, the system can further comprise: an exhaust heat exchanger; an impeller housing, a confusor/stator housing; and an upper and lower steering nozzle, wherein the exhaust heat exchanger heats the impeller housing, the confusor/stator housing and the upper and lower steering nozzles.

In some implementations, the system can further comprise: a lower steering nozzle, the lower steering nozzle being interchangeable. In some implementations, the lower steering nozzle can include a steering vane, the steering vane being retractable and maintaining the lower steering nozzle in straight position when a marine vessel is in motion.

In some implementations, the system can further comprise: an upper and lower steering nozzle being interchangeable to permit a change in height of the efflux of the lower nozzle to accommodate the alignment of the efflux with the keel of the hosting vessel of the apparatus.

In some implementations, the system can further comprise: intake flow directing guide vanes, the intake flow directing guide vanes being positioned in front of an impeller, the intake flow directing guide vanes direct the water stream from the intake opening to the face of the impeller.

In some implementations, the system can further comprise: an upper steering nozzle; and a lower steering nozzle, wherein the lower steering nozzle is removably attached to an end of the upper steering nozzle.

In some implementations, the system can further comprise: flow guide vanes, the flow guide vanes being positioned around an interior of the lower steering nozzle radius thereby controlling a water stream through a radius of the lower steering nozzle.

In another implementation, a mass flux propulsion unit for a marine vessel can comprise a confusor/stator; a steering control nozzle assembly; and a radius connection. The radius connection can be introduced at a transition point between the confusor/stator housing and the upper nozzle of the steering control nozzle assembly so that the flow exiting the confusor/stator housing continues into the upper nozzle of the steering control nozzle assembly without turbulence over flow differential presented by the range of operation of the apparatus required to provide varying vessel speeds, maneuvers in changing sea conditions.

BRIEF DESCRIPTION OF THE DRAWINGS

The foregoing and other objects of the present disclosure will be apparent upon consideration of the following detailed description, taken in conjunction with the accompanying drawings and claims, in which like reference characters refer to like parts throughout, and in which:

Figure 1:
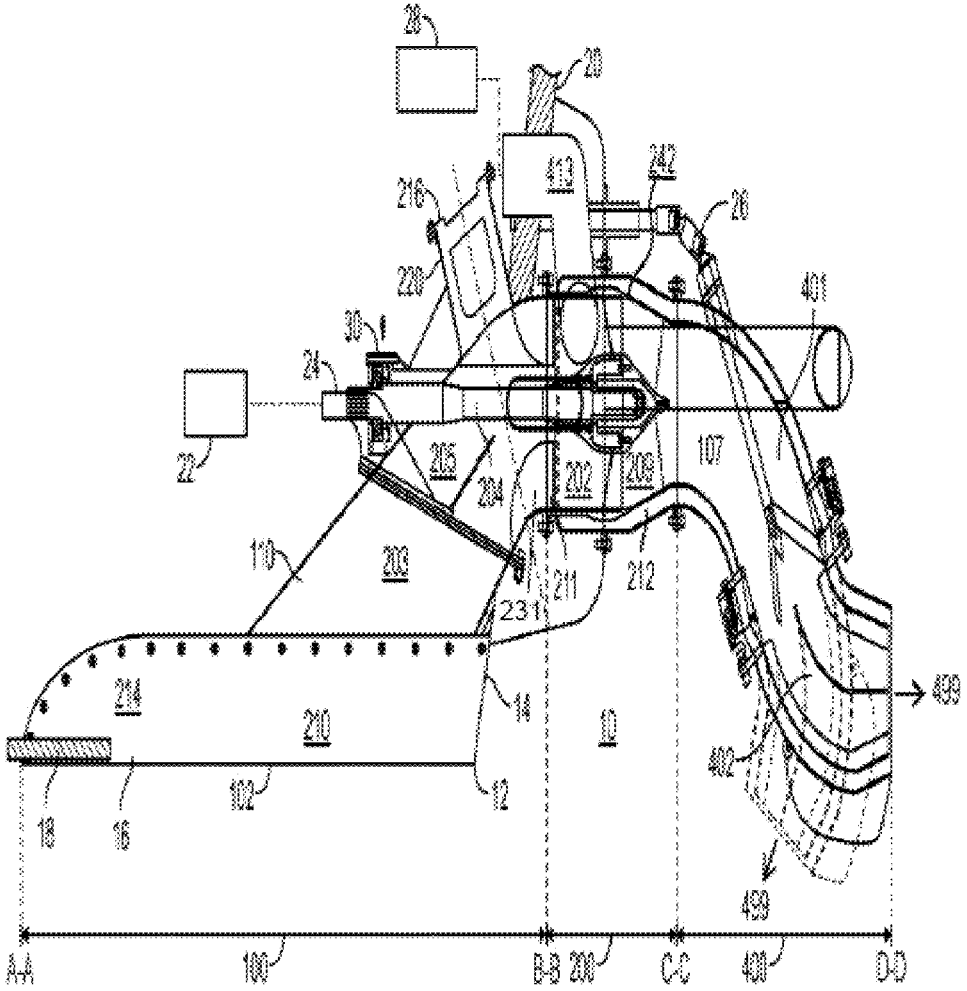
FIG. 1 is an illustration of a marine ducted propeller mass flux propulsion apparatus according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION

Exemplary embodiments of the methods and systems of the present disclosure will now be described with reference to the figures. U.S. Pat. Nos. 5,123,867 and 6,027,383 also describe conventional jet propulsion units, both of which are incorporated by reference.

The disclosed technology provides a propulsion system that substantially enhances propulsive efficiency. The efficiency can be obtained by (1) converging a passing water mass on a volumetric basis in stages as exhibited by fluid flow through staged nozzles similar to the flow through a single propeller nozzle apparatus without the losses and (2) accommodating the mass of the internal working parts of the system volumetrically in the flow volume thereby enhancing the convergent properties (i.e., the merging of the sections of the mass flow passage) given by sections of the housing to create a steady state flow through the apparatus. In use, an axial cross-sectional flow area based on water volume remains constant in stages from the inlet to the outlet without resistance of the mass of the internal working parts representing a restriction or obstruction to the flow. Also, a use of a staged volumetric nozzle design in the present disclosure reduces turbulence and enhances solid plug-flow or solid state character of the steady state water stream more efficiently. In other words, a passage of the disclosed technology can extend from an intake opening of an intake section to an outlet of a discharge section. This passage can have intermittent convergent sections with parallel sections for controlling the steady-state flow volume wherein the axial cross-section area of the passage is increased and decreased throughout the length of the passage to accommodate a volumetric mass of the plurality of the internal working parts.

FIGS. 1-6 illustrate a marine ducted propeller mass flux propulsion apparatus 10. Mass flux can be defined as a rate of flow mass (water) per unit area. This coincides with a flow density through the apparatus 10 where a flow is constant across any cross-section of a mass flow passage 122 perpendicular to an axis of the mass flow passage 122 as the flow is driven through the apparatus 10 by a prime mover 22.

In some implementations, the apparatus 10 can include an exhaust heat exchanger 413 that encases an impeller housing 251, confusor/stator housing 242, upper steering nozzle 401 and lower steering nozzle 402 thereby creating a heat exchanger duct 212. The exhaust heat exchanger 413 can heat the impeller housing 251, the confusor/stator housing 242 and the upper steering nozzle 401 and lower steering nozzle 402 via the heat exchanger duct 212 which in turn can improve the Coefficient of Viscosity. This can impart heat to the water via heat exchanger duct 212, reducing the drag coefficient or the boundary layer effect of the internal surface of the housing material and increasing flow viscosity. A benefit of the exhaust exiting around the lower steering nozzle 402 can be that it provides a pocket of exhaust for an exiting column 499, reducing the drag losses of the exiting column 499 hitting the surrounding solid water and improving the reactionary effect of the potential energy in the column to kinetic energy or thrust.

Figure 4:
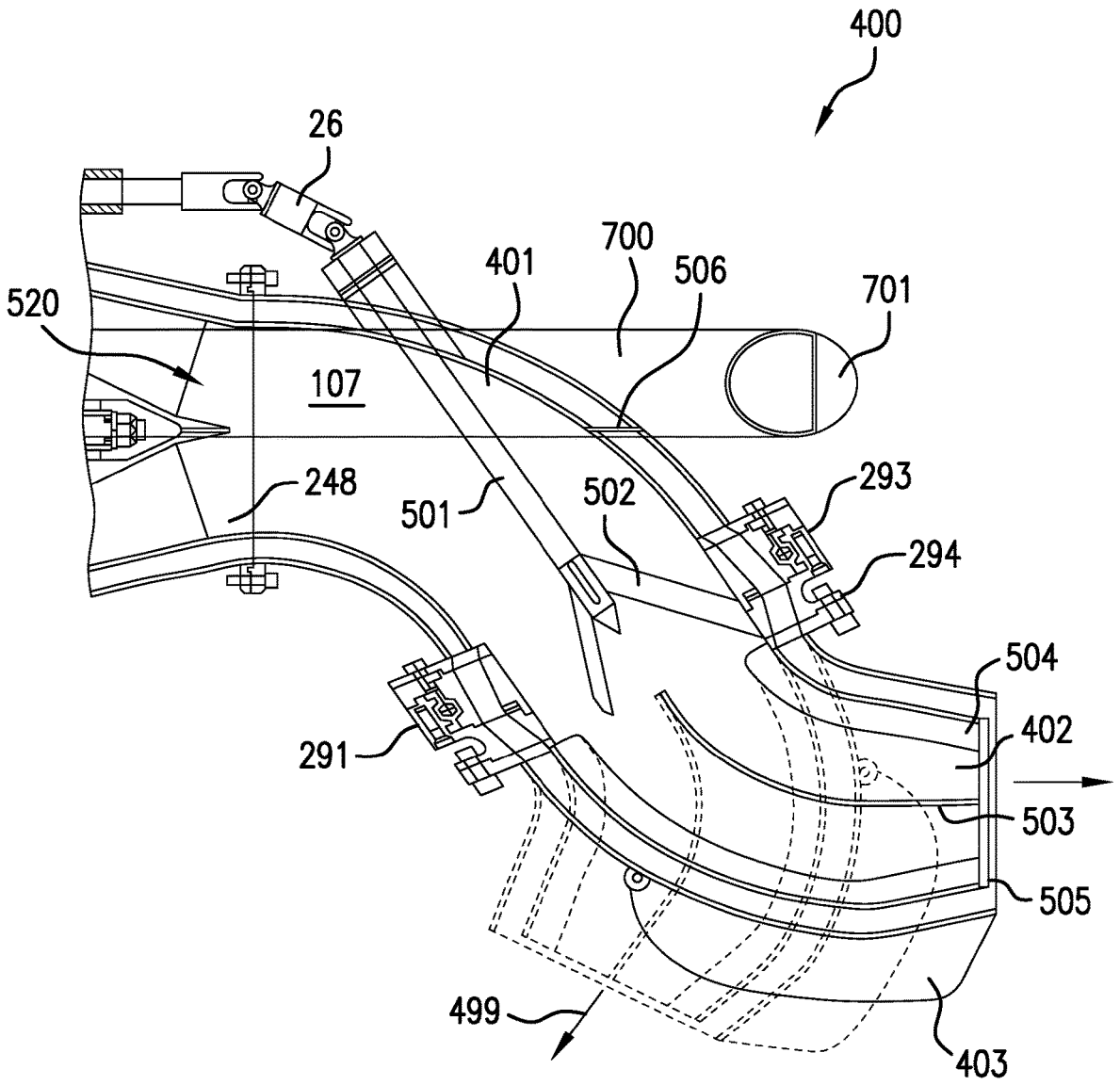
FIG. 4 is an exploded view of a marine ducted propeller mass flux propulsion apparatus according to an exemplary embodiment of FIG. 1.

Referring to FIGS. 1 and 4, the ducted propeller mass flux propulsion system 10 functions similarly to an axial flow, positive head pump having a convergent intake section 100 extending between lines A-A to B-B, an impeller/confusor/stator section 200 extending between lines B-B to C-C and a discharge section 400 between lines C-C to D-D. A solid-state water column can be induced into a mass flow passage 122. The mass flow passage 122 can include an intake passage 102, an impeller passage 110 and a discharge passage 107. The mass flow passage 122 allows the solid-state water column to be energized and accelerated from the intake passage 102 through the impeller passage 110 and discharged from the discharge passage 107 thereby providing thrust for a marine craft 12. The intake passage 102 is primed by at atmospheric pressure when marine craft is at rest.

The marine craft 12 has the ducted propeller mass flux propulsion system 10 installed in a rear section 14 so that the intake section 100 of the propulsion system 10 is incorporated into the bottom of the hull 18 using an hull adapter plate 210 while the discharge section 400 of the propulsion system 10 can be supported by transom 20 and can extend out a rear of the boat 12 in place of an ordinary propeller. The propulsion system 10 is shown diagrammatically in two of its 360 degree thrust positions: F—the forward propulsion position and R—the reverse propulsion position. A prime mover 22 is directly attached to an impeller shaft 24 and a steering linkage 26 is attached to a steering module 28 of the propulsion unit 10.

An interchangeable thrust bearing assembly 30 also provides for the thrust bearing to be changed in position whether the marine craft 12 is in or out of the water by disconnecting a drive coupling positioned at the end of a drive shaft and removing the securing bolts, which then allows the interchanging of the shaft thrust bearing assembly 30. The thrust bearing assembly 30 is designed to be self-greasing to ensure that the bearings and seals are always lubricated.

Figure 2:
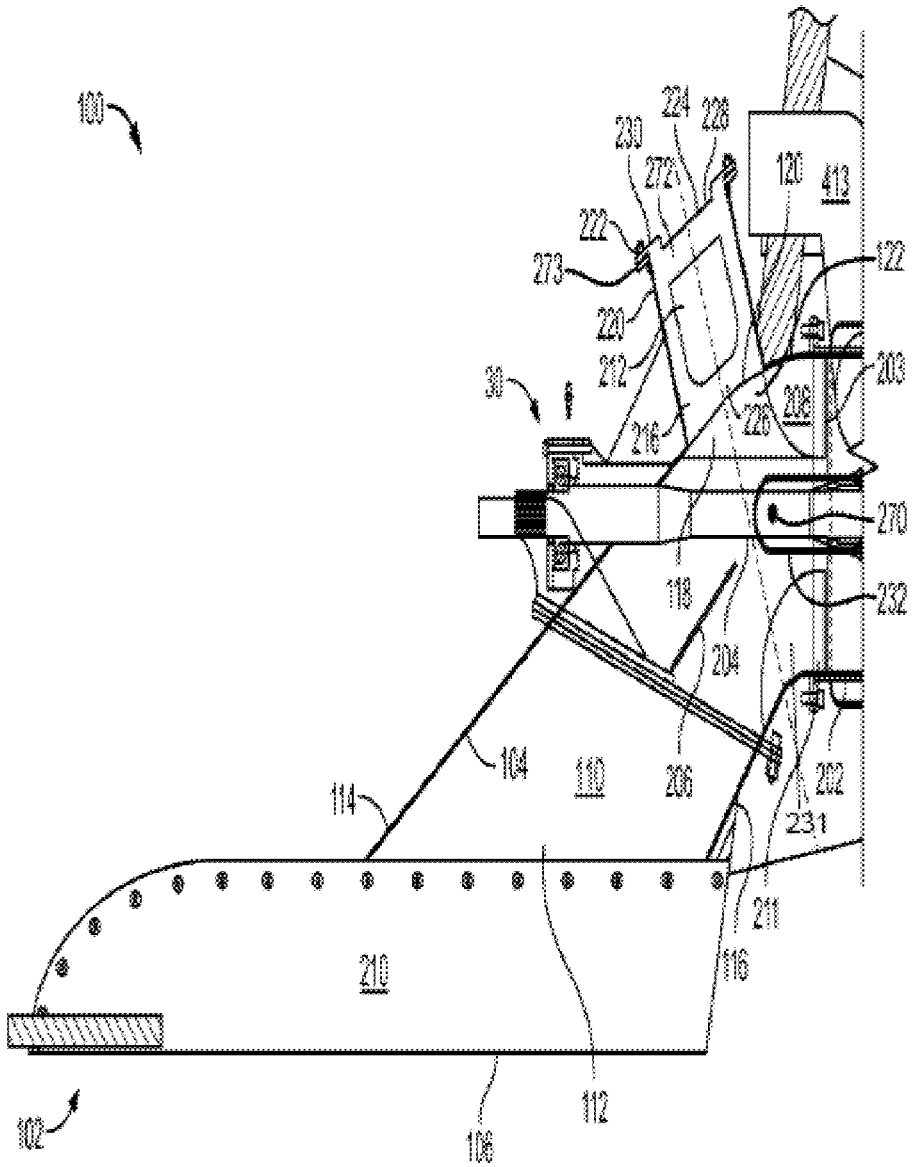
FIG. 2 is an exploded view of a marine ducted propeller mass flux propulsion apparatus according to an exemplary embodiment of FIG. 1.

As shown in FIGS. 1 and 2, the intake section 100 defines the intake passage 102, which can be convergent, and communicate between an intake opening 106 formed in a bottom surface of the hull at one end and an impeller intake 205 to the impeller/confusor/stator section 200 at the other end.

Intake passage 102 can initially be rectangular or elliptic and transition into a circular shape in a manner that can control convergences of the water flow to a face of impeller 202 thereby enhancing flow characteristics. As shown in FIG. 2, the intake passage 102 can include two vertical walls 112, a long sloping wall 114, and a short sloping wall 116 converging onto a cylindrical chamber 118 at bend 120.

Figure 3:
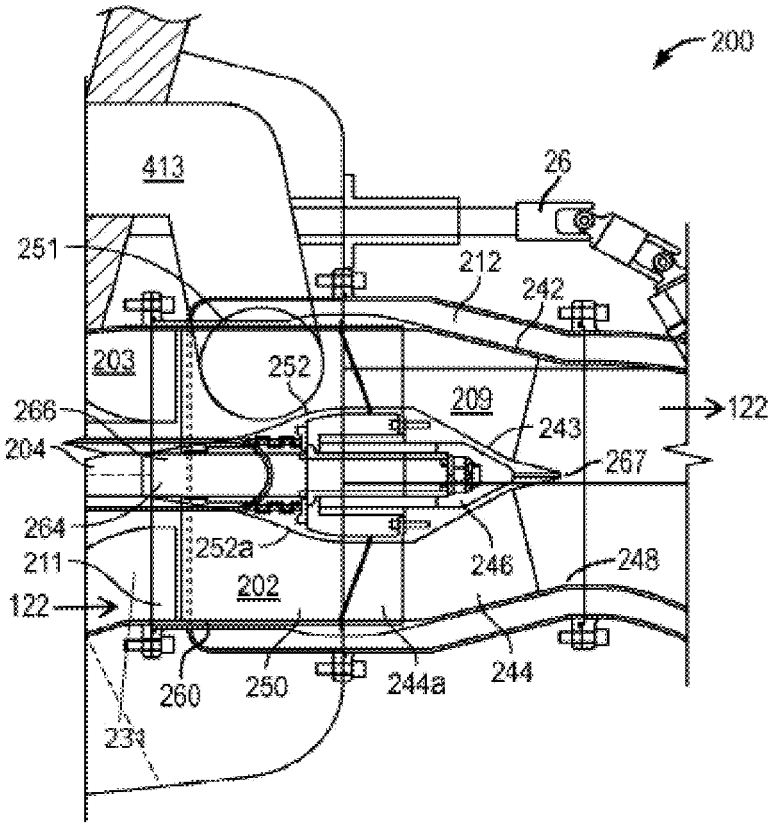
FIG. 3 is an exploded view of a marine ducted propeller mass flux propulsion apparatus according to an exemplary embodiment of FIG. 1.

Following bend 120, the mass flow passage 122 can be cylindrical. Converging walls of the mass flow passage 122 are suitably smoothed and rounded at places of intersection to facilitate flow without turbulence. Typically, the angle of bend 120 varies from, but is not limited to, about 30 to about 45 degrees depending on specific design requirements and also can be adjusted to accommodate the volumetric mass of the internal working parts. In some implementations, a cross-sectional area for the mass flow passage 122 can vary (in other words, both decrease and increase) throughout its length. For example, as shown in FIG. 3, the cross-sectional area of the mass flow passage 122 can increase in certain areas to accommodate the internal working parts. This variation in the cross-sectional area allows the water volume to remain equal in steady-flow over the length of the passage.

Internal working parts can be defined as any parts of the mass flux propulsion apparatus 10 that exist within the mass flow passage 122 and can be an obstruction to water flow. For example, the internal working parts can include portions of a drive shaft 204, straightener intake flow guide vanes 206, pre-swirl stator vanes 208, an impeller housing 251, an impeller hub 252, impeller blades 250, a confusor/stator housing 242, a confusor/stator hub 243 an interchangeable blade assembly 245 including interchangeable blades 244*a* and stator vanes 244, a steering shaft 501, spoke vanes 502, and flow guide vanes 503-505. These internal working parts impart a drag force on the water volume/velocity when they are encountered decreasing flow velocity relative to the size of the solid object. Expanding the walls of the mass flow passage 122 around these parts accommodates the object's volumetric mass, and accordingly the drag force on the water volume/velocity is reduced considerably, enabling the flow to remain steady, thereby conserving the volumetric flow rate replicating the power output of the prime mover at a maximum reflective efficiency.

As shown in FIG. 2, the impeller intake 205 can include shaft 204, straightener intake flow guide vanes 206 and pre-swirl stator vanes 208, while maintaining a Reynolds Number (Re) between 2300 and 4000 but typically closer to 2300. The cross-sectional area of impeller intake 205 is preferably proportional to the cross-sectional area at intake passage 102 to an impeller 202 at a ratio varying from about 1.5 to about 2.5:1 and also can be adjusted to include the volumetric insertion in the flow of the mass of the drive shaft 204, straightener intake flow guide vanes 206 and pre-swirl stator vanes 208 by increasing the external dimensions accordingly.

The internal flow characteristic of an impeller passage 110 can accommodate the intake grill 16 set in the intake hull adapter plate 210, drive shaft 204, straightener intake flow guide vanes 206 and pre-swirl stator vanes 208, by cross-sectionally adjusting the shape of the intake housing 203 from the intake entrance to the impeller intake 205 to the impeller face to accommodate the volumetric intrusion of the grill 16 in the intake hull adapter plate 210, drive shaft 204, straightener intake flow guide vanes 206 and pre-swirl stator vanes 208 to ensure that the convergent flow through the lower intake 203 impeller intake 205 to the impeller 202 is uninhibited. Not doing so can create a flow restriction, which can induce a pressure change in the flow to the impeller 202 (shown in FIG. 3 in more detail), which can induce pressure changes and aeration in the flow and cavitation.

Situated along the intake walls of impeller intake 205 in front of the impeller 202 is a straight parallel tube section 211 of a minimum length equal to approximately 15 to 25% of the impeller blade width depending on the hub diameter adjusted to accommodate the volumetric mass of the internal working parts within its parameters where the flow with the pre-swirl stator vanes 208 is induced to flow in a solid steady state or plug flow state to the face of the impeller 202. Other straightener intake flow guide vanes 206 are spaced radially along the side surfaces of impeller intake 205 so that equal volumes of water may be directed through the pre-swirl stator vanes 208 to the periphery of the impeller 202. The parallel section 211 has an outlet cross-section area equal to the inlet cross-section adjusted to accommodate the volumetric mass of the internal flow guide vanes. The pre-swirl stator vanes 208 minimize radial loads on the impeller 202 for optimized flow efficiency so the fluid is presented to the face of the impeller 202 in a solid plug flow state. The pre-swirl stator vanes 208 also act to dampen any preliminary pre-rotation or turbulence in the inlet water column to the impeller 202. It is important that the internal flow characteristic of the impeller intake 205 and lower intake 203 accommodates the volumetric intrusion of the straightener intake flow guide vanes 206, shaft 204, pre-swirl stator vanes 208 by cross-section adjustment to the housing shape of the intake transition from the lower intake 203 through the impeller intake 205 to the impeller face to ensure that the flow through the lower intake 203 to the impeller intake 205 is volumetrically uninhibited or restricted. Not doing so can create a flow restriction which can induce a pressure change in the flow to the impeller 202 which can induce pressure changes and aeration in the flow and cavitation in the impeller 202.

Within intake passage 102, an intake grill 16 can be disposed adjacent the hull opening. The mass of this grill 16 will be volumetrically displaced in the intake passage 102 set in the hull adaptor plate 210 so as not to present a restriction to incoming flow. If this is not done the flow can potentially diffuse as it passes through the intake grill 16 causing a low pressure drop on the intake side of the intake grill 16 causing turbulent flow or aerated liquid at a reduced pressure to be presented to the face of the impeller 202. This will induce cavitation from the face of the impeller along its blades widths. Grill 16 as part of hull adapter plate 210 is typically a span of parallel bars disposed lengthwise of the hull 18 angled down and to the rear of the hull adapter plate 210. The bars of grill 16 as part of hull adapter plate 210 have streamlined or hydrofoil cross-section in the direction of the incoming stream to create minimal resistance to water flow. The spacing between bars of grill 16 as part of hull adapter plate 210 should preferably not exceed the spacing between interchangeable blades 244*a* of the interchangeable blade assembly 245 and stator vanes 244 so that the largest objects entering the impeller 202 may pass through the diffuser vanes.

A hull adapter plate 210 of the intake system 100 can be adjusted by design to accommodate hull dead rise variations to ensure the smooth entry of solid state water into the lower intake 203 at the correct angle and flow proportions to maximize the solid-state flow input velocities to the impeller 202. This part also works in conjunction with the intake pressure release by-pass valve 232 by assuring the pressure build up in front of the impeller 202 does not exceed its designed needs or induce drag under the hull by creating a back-up pressure back down the impeller intake 205 and lower intake 203. This release pressure has been determined by testing to be in the range between 3 to 6 psi depending on apparatus application.

A variable-sized lower intake 203 can be provided in different sizes and lengths to allow the installation of the propulsion system 10 to be adapted to any type of vessel and its prime mover regardless of its hull shape, size or dead rise or speed and will connect to a matching impeller intake section 205 by means of a coupling or bolt assembly. The impeller/confusor/stator section 200 is installed in the rear section of the hull so that forward motion of the vessel and subsequent elevation off the surface of the water, in the case of planing hulls, enables the impeller/confusor/stator section 200 to be positioned slightly below the water level of the craft hull. However, for proper operation at rest or at low speed, the unit 10 should be installed so that at least about 60 to 80 percent of impeller 202 cross-sectional area is submerged when the vessel is at rest. Lower intake 203 and impeller intake 205 are bolted, for example, to the hull or transom by means of the adaptor plate 210.

If fouling inside impeller intake housing 205 occurs, an arm-hole duct 216 is provided to enable quick access to impeller passage 110. Duct 216 is situated at bend 120 and comprises a cylindrical housing 220, with an outer flange 222 and a plug 224. Plug 224 is provided with a solid section 226 affixed to a flanged cover 228 which completely fills the duct housing 220. Section 226 is provided with a smooth contoured surface that matches the surface section removed from the impeller intake housing 205 in bend 120 when duct 216 is installed. Duct 216, when properly plugged in position, poses no flow disruption. Flange 222 is provided with upstanding threaded bolts 230 which are inserted into bolt holes in flange 222 so that plug 226 may be properly aligned when installed. Handle 272 attached to cover 228 provides additional alignment indicia. A sensor 273 can be positioned between the flange 222 and duct 216 to activate a prime mover shut-off mode if there is an attempt to remove the plug 224 when the prime mover 22 is running.

An intake pressure release bypass valve assembly 232 can also be fitted in impeller intake housing of impeller intake 205 near straight parallel tube section 211 shown in FIGS. 1 and 2. Excess water is bled through the pressure release bypass valve assembly 232 if water pressure between the intake opening 106 in the hull adaptor plate 210 at the hull of the vessel 12 and the face of the impeller 202 exceeds a designed flow volume of 3 to 6 psi. Excess water buildup, known colloquially as balling, is a common occurrence in marine traditional jet propulsion units. Occurring at high vessel speeds when the vessel is undergoing sharp maneuvers and/or during rough sea conditions, excessive surging water in the impeller passage 110 can exert a back-pressure in the impeller intake 205 and in front of the impeller 202, which creates a pressure build up at the intake entrance in the hull adaptor plate 210, introducing flow resistance under the vessel. This introduces a drag characteristic upon the hull of vessel 12 and affects the propulsive efficiency of unit 10. The bypass valve assembly 232 functions as an anti-balling device, relieving pressure to the face of the impeller 202 and in the intake and neutralizing the back-pressure effect. For optimal functionality, pressure in front of the impeller should not exceed 3 to 6 psi. The intake pressure release bypass valve assembly 232 can work in conjunction with the adapter plate 210 by allowing for any excessive pressure build up in front of the impeller 202 to be released around the impeller into the exhaust heat exchanger 413. The intake pressure release bypass valve assembly 232 can be set to the desired pressure release as may be needed subject to sea conditions or the work load of the vessel to improve unit performance. Valve assembly 232 is controlled automatically by pressure sensors 270 attached to the side of the upper intake housing 203 which relay the running pressure before the impeller 202 so the valve can be adjusted by a programmable controller (not shown). Without the ability to release pressure release, there may be incidents of pressure build up in front of the impeller 202 and down the impeller intake 205 and lower intake 203, causing a drag effect at the intake entrance and further affecting the characteristics of the host vessel. The flow emanating from the intake pressure release by-pass valve assembly 232 exits into the exhaust heat exchanger 413.

The impeller/confusor/stator section 200 of the present invention, as seen in FIGS. 1 and 3, from line B-B to line C-C, is shown to incorporate a single stage impeller 202. The impeller/confusor/stator section 200 comprises (1) the impeller 202, which includes the impeller housing 251, impeller wear sleeve 260, an impeller hub 252 and blades 250 and (2) the confusor/stator 209, which includes the confusor/stator housing 242, confusor/stator hub 243 and interchangeable blades assembly 245 including interchangeable blades 244*a* and stator vanes 244.

Figure 5:
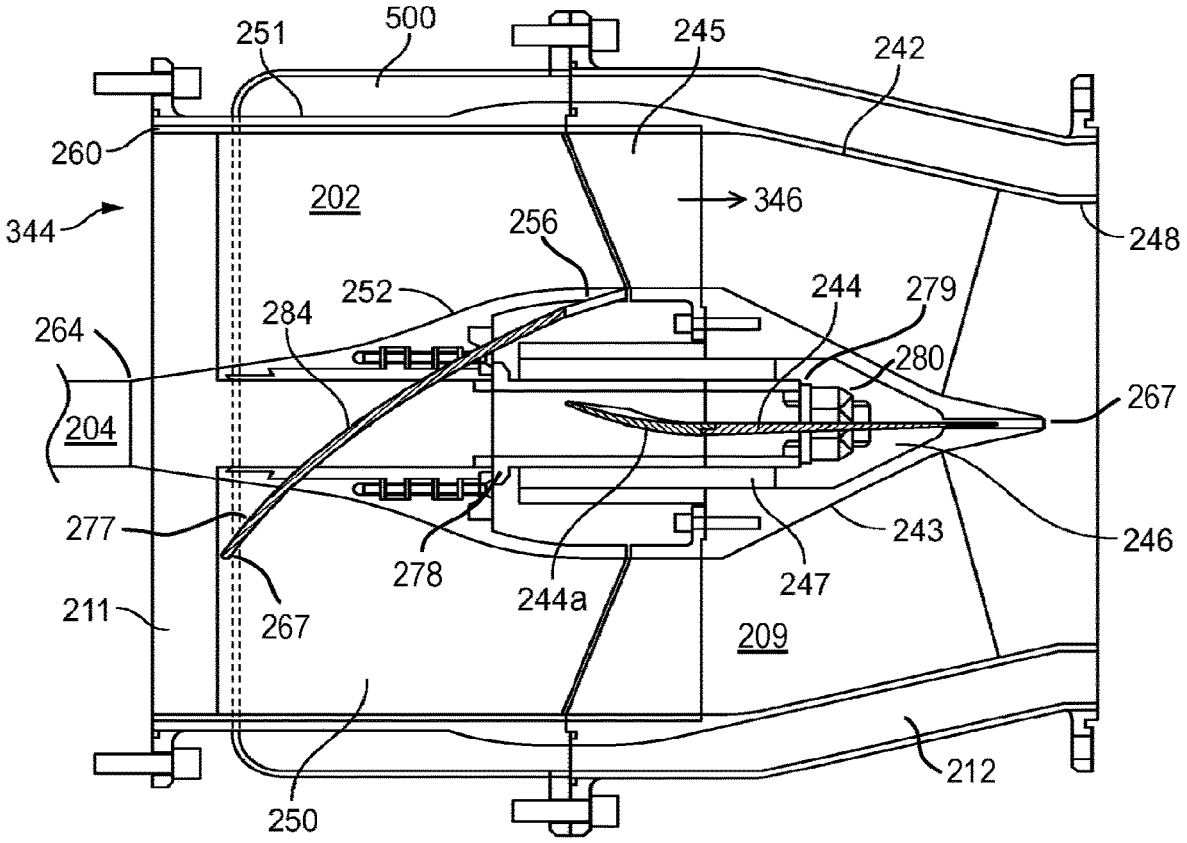
FIG. 5 is an illustration of an impeller and a diffuser/stator for a marine ducted propeller mass flux propulsion apparatus according to an exemplary embodiment of FIG. 1.
Figure 6:
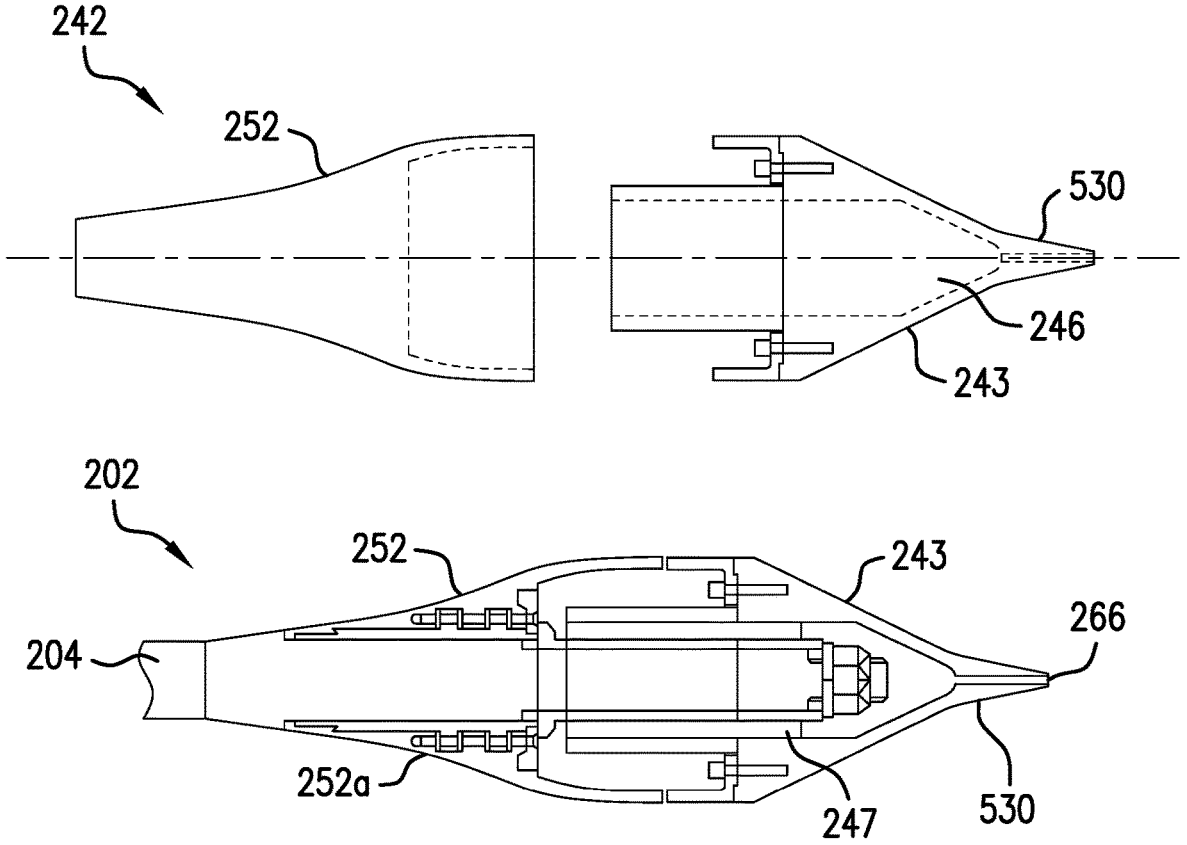
FIG. 6 is an illustration of an impeller hub and a confusor/stator hub for a marine ducted propeller mass flux propulsion apparatus according to an exemplary embodiment of the present disclosure.

Impeller housing 251 is cylindrical with a generally uniform diameter at the inlet port 344 and discharge port 346 into confusor/stator (see FIG. 5). Confusor/stator housing 242 is cylindrical with a section of generally uniform diameter tapered inwardly from a maximum diameter adjacent the impeller/confusor/stator section 200 to a minimum diameter adjacent the discharge section 400. The divergent inside surface of impeller hub 252 has an outlet cross-sectional area preferably proportional to the impeller intake 205 cross-sectional areas at a ratio varying from about 0.5 to 0.75:1 adjusted to accommodate the volumetric mass of the internal working parts of the impeller 202 being the blades 250 and impeller hub 252. The preferred ratio is about 0.60 to about 0.70:1, adjusted to accommodate the volumetric mass of the internal working parts of the impeller 202 being the blades 250 and impeller hub 252, and optimally about 0.64:1, so that volumetric displacement of confusor/stator hub 243 and interchangeable blades assembly 245 including interchangeable blades 244*a* and stator vanes 244 is equal to the volumetric displacement leaving the trailing edges of the parallel section 256 of impeller 202. Volumetric displacement of the confusor/stator hub 243 is from about 75 to about 90 percent adjusted to accommodate a volumetric mass of the internal working parts of the impeller 202 being the blades 250 and impeller hub 252. Furthermore, the annular flow channel provided by the impeller 202 and the confusor/stator 209 combination in the impeller hub 252 has smooth substantially contiguous inner and outer surfaces for preventing turbulent boundary eddies. An important design criterion of impeller/confusor/stator section 200 is that the cross-sectional area of the impeller hub 252 and confusor/stator hub 243 should be the same at the junction point.

The impeller blade sections 252*a* are interchangeable, making it possible to easily replace individual impeller blades 250 on the assembled impeller 202 if one or more blades 250 are damaged or to change the pitch or the number of blades of the impeller 202 for different applications. An essential aspect of impeller 202 is that impeller blades 250 are fixed along an outwardly tapered convex surface 254 of the detachable impeller hub 252 rather than a flat section as is typical in the prior art impeller design.

Figure 7:
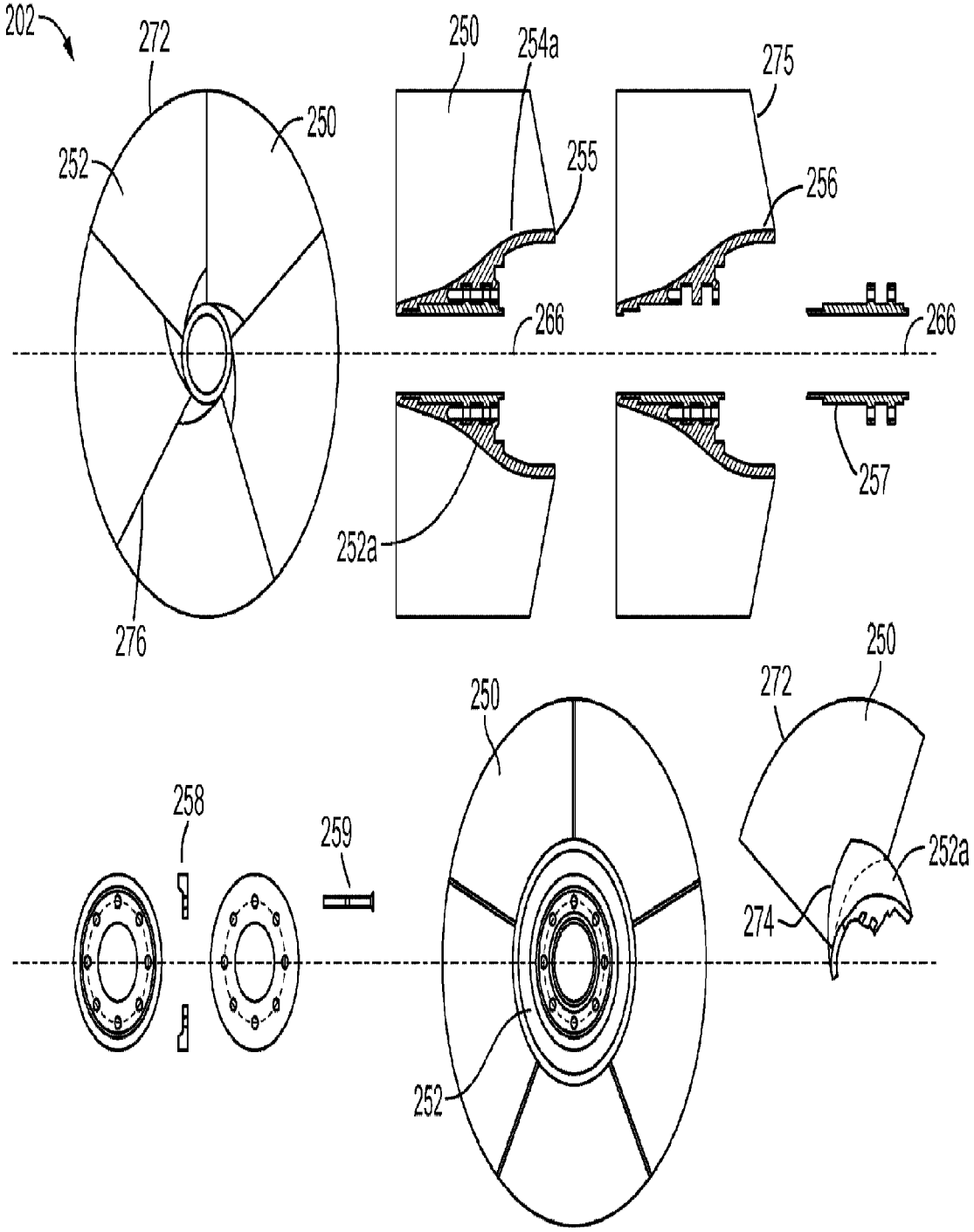
FIG. 7 is various views of an impeller for a marine ducted propeller mass flux propulsion apparatus according to an exemplary embodiment of the present disclosure.

An assembled impeller hub 252, shown in FIGS. 5 and 7, preferably has an outwardly tapered convex surface, and annular interior, more preferably, impeller hub 252 has an outer surface comprising a concave portion 254, a convex portion 254*a* and a parallel section/shoulder 255 when viewed in axial cross-section and an annular interior FIG. 7. Assembled impeller hub 252 has an outer surface with a narrow diameter leading end 253, an increasing variable diameter mid-portion 254 and a large diameter trailing straight end 255. Distal end of shaft 204 extends through a concentric axial bore 266 the length of impeller hub 252. Leading end has an annular end surface abutting a shoulder 264 on shaft 204 to present a smooth, continuous surface for fluid flow. Annular walls of assembled impeller hub 252 are substantially of constant thickness except for a distal annular end extending outwardly from bore 266 providing an engageable surface blade section retainer 257 and for a locking sheath 258 and bolt 259.

Impeller 202 has blades 250 attached along the contoured surface of impeller hub 252 at an inclination designed to maximize blade exposure to the passing fluid and reduce radial acceleration component imparted by impeller 202. Blade 250 has a convex outer radius 272, a concave inner radius 274, an extended trailing edge 275, a long leading edge 276, broad surface sides having a midpoint 284 (FIG. 5), and thickness.

The inclination of impeller blades 250 is defined as an average inclination or degree of twist in the length of blades 250 as determined from the perpendicular with respect to a line tangent to the outer surface of the assembled impeller hub 252 at the leading edge and at the trailing edge. When viewed along either the inner radius 274 or outer radius 272 or when viewed down either leading or trailing blade edge, an average angle of inclination of both leading 276 or trailing edges 275 is preferably in a range from about 20-40 degrees off the perpendicular, more preferably about 30 degrees off the perpendicular with one edge inclined opposite the other as required by blade 250 to follow impeller hub 252 surface contour. The leading edge 276 is twisted into the direction of the advance of the impeller 202. It will be appreciated the leading edge 276 corresponds to the leading end of impeller hub 252 which has a narrow diameter and the trailing edge 275 corresponds to a trailing end of impeller hub 252 and that the mid-section radial width of blade 250 is a function of the radius of mid-section portion of hub impeller hub 252 so that impeller diameter is substantially constant. The overall length of blade 250 is equal to the length of assembled impeller hub 252 plus the angular component.

A thickness 284 of blade 250 is shown in FIG. 5 in a radial direction. This low profile foil design has leading edge 276 that can be substantially uniform or tapering with a maximum thickness at a midpoint approximately equidistant from either edge. The leading-edge entry angle 277 needs to be between 13 and 15 degrees related to the rotary velocity of the impeller 202.

FIG. 7 shows a typical fan of five blades extending along assembled impeller hub 252. The number of blades, impeller diameter and degree of inclination may be optimized in relation to the power supplied by prime mover 22 and the required design consideration of the vessel at hand.

The internal flow characteristic of the impeller housing 251 can accommodate the volumetric displacement of the impeller blades 250 and impeller hub 252 by cross section by adjusting the shape and the dimensions of the impeller housing 251. This will allow the transition of the flow from the impeller intake 205 through the impeller 202 to the confusor/stator 209 to be without restriction and will maintain the correct flow volume velocities to the discharge section 400. Not doing so can create a change in the flow characteristic through the system, resulting in cavitation at the leading edge of the impeller blades 250 or an induced pressure change in the flow to the confusor/stator 209 and into the discharge section 400, which can induce turbulent flow or flow choke and a resulting back pressure reducing efficiency and eventually causing a hydraulic brake effect.

The pitch effect of the impeller blade(s) 250 on the accelerated flow can be enhanced by the extension of the blade width beyond the required pitch length by adding a continued parallel section 256 approximately 5 to 15 percent of the hub length depending on apparatus application to end of the assembly impeller hub 252 and to the width of the blades representing a continuation of the exiting pitch of the blade 250. The designed pitch of the impeller blade 250 can be a combined interpretation of the required efflux velocity efficiency and the power available from the power source driving the impeller 202. This power source can be from any type of drive or prime mover, whether it is electric, gasoline, diesel, gas or alternative fuel driven. The added blade width over the parallel hub section works with the interchangeable blades assembly 245 to enhance the efficiency transfer and solid state of the rotating exiting flow velocities off the back of the impeller blades 250 to linear, laminar type flow through the confusor/stator 209 on to the discharge section 400. Similar to the ability to match traditional propellers to the needs of a vessel by adjusting the propeller diameter to pitch ratios or vis versa, the adjustment of the extension of the added blade width on the parallel section 256 on the impeller hub 252 provides the ability to enhance the performance and efficiency of the impeller output to more accurately equal the power output of the prime mover 22 at a maximum reflective efficiency. A spacer to the face of the leading annular end surface abutting a shoulder on the shaft presenting a smooth, continuous surface for fluid flow matching the trailing edge adjustment to the blade width ensures the tolerance between the trailing edge 275 of the impeller blades and the leading edges 276 of the confusor/stator 209 is maintained. The internal flow characteristic of the impeller hub 252 can accommodate the volumetric displacement of the impeller blades 250 and the added pitch extension by cross-section by adjusting the impeller hub diameter or by adjustment of the impeller hub displacement in the flow volume. This can allow the transition of the flow from the lower intake 203 to the impeller intake 205 through the impeller 202 to the confusor/stator 209 to be without restriction and maintain the correct flow volume and velocities through the confusor/stator 209 on to the discharge section 400. Not doing so can create a change in the flow characteristic through the system resulting in a drop in propulsive efficiency proportional to the inconsistency eventuating, at an expediential rate, in system failure.

A durable plastic removal and replaceable impeller wear sleeve 260 can be provided to stop wear and tear to the impeller blades 250. The clearance dimension between the blade tips and the internal wall of the removal and replaceable impeller wear sleeve is critical and should be no more than and no less than touch contact.

The internal flow characteristic of the confusor/stator 209 can accommodate the volumetric displacement of the confusor/stator hub 243, interchangeable blade assembly 245 including interchangeable blades 244*a* and stator vanes 244 of the confusor/stator 209 by cross section by adjusting the shape of the confusor/stator housing 242. This can allow the transition of the flow off the back for impeller blades 250 through the confusor/stator 209 to the upper steering nozzle 401 of the discharge section 400 to be without restriction and maintain the correct flow volume and velocities to the upper steering nozzle 401. Not doing so can create a change in the flow characteristic through the system resulting in turbulent flow or flow choke with resulting back pressure. This can lead to cavitation at the leading edge of the impeller blades 250, which can induce expediential pressure change in the flow to the confusor/stator 209 and on to the upper steering nozzle 401 resulting in reduced efficiency and eventual system failure.

The interchangeable blade assembly 245 can allow for the changing of the leading-edge blades to the confusor/stator 209 to be replaced if damaged or to change the pitch of the leading edge of the interchangeable blades 244*a* if they need to be adjusted to meet the needs of the trailing edge velocities of the impeller 202 or a change in pitch or the number of blades of the impeller blades 250.

The radii of the leading edge of the interchangeable blades 244*a* of interchangeable blade assembly 245 to the stator vanes ports 249 of vanes 244 can be of a greater radius than in previous designs to ensure a less turbulent transition of the flow from the impeller blade 250, which can allow the change from rotary flow to linear/laminar type flow to be less aggressive, reducing turbulent flow while enhancing plug flow. The entry angle of the interchangeable blades 244*a* of interchangeable blade assembly 245 needs to correspond to the velocity of the flow off the trailing edge of the impeller blades 250 of impeller 202. The leading radius of each blade 250—can extend to approximately half way down the interchangeable blade 244 a height. The change in radius and the resulting change in the interchangeable blade 244*a* shape can be incorporated in the volumetric flow characteristics of the confusor/stator housing's 242 internal flow characteristics and/or the hub supporting the confusor/stator stator vanes 244 providing a more precise convergent flow effect on the ensuing flow characteristic than was attainable previously.

The exit radius 248 to the confusor/stator 209 can be adjusted to be increased. The sharp angled transition from the confusor/stator 209 exit to the discharge section 400 can cause inducement of flow turbulence as the flow transitions from the confusor/stator 209 to the discharge section 400. This sharp and sudden change in angle as shown in U.S. Pat. Nos. 5,123,867 and 6,027,383, induces flow turbulence and boundary layer drag at higher flow velocities at the diffuser exit restricting flow and creating back pressure, which can affect the efficiency of the impeller 202 by presenting a resistance to the flow off the back of the impeller blades 250. Increasing this radius provides for the reduction of the acceleration of the flow in proportion to the constant velocity acceleration imparted to the flow by the impeller 202 under power and the convergent flow characteristic provided by design. The flow needs to be maintained in steady state, to be controlled through the expediential flow acceleration of the apparatus without the flow becoming turbulent in nature, which induces back pressure. By introducing an increased radius at the transition point 520 from the confusor/stator 209 to the discharge section 400, the reduction of turbulent flow has been discovered to be reduced experientially and proportional to the increase of the radial length of the provided radius at the points of contact of the confusor/stator 209 and the discharge section 400.

The confusor/stator 209 is disposed immediately adjacent the impeller 202 and is designed to work in conjunction with impeller 202 to achieve several important performance functions: (1) damping a radial acceleration component imparted by the impeller 202; (2) diffusing/converging the path of the water throughput across the entire impeller area cross-section; (3) preventing Net Positive Suction Head (NPSH) defined as partial vaporization of the passing fluid resulting from a vacuum associated with impeller action by providing a proportionally resistant artificial back pressure upon impeller 202; (4) reducing turbulence ensuring a steady state flow column in the upper nozzle and sustaining a lower Reynolds number and (5) allowing maximum reaction of the impeller 202 and permitting more efficient transfer of the prime movers 22 available energy into potential energy. Any degree of vapor present would introduce uneven loading on impeller 202 and cavitation. These performance functions are improved by the volumetric flow characteristic of the confusor/stator 209 being adjusted to accommodate the volumetric mass of the internal working parts of the confusor/stator 209.

Figure 8:
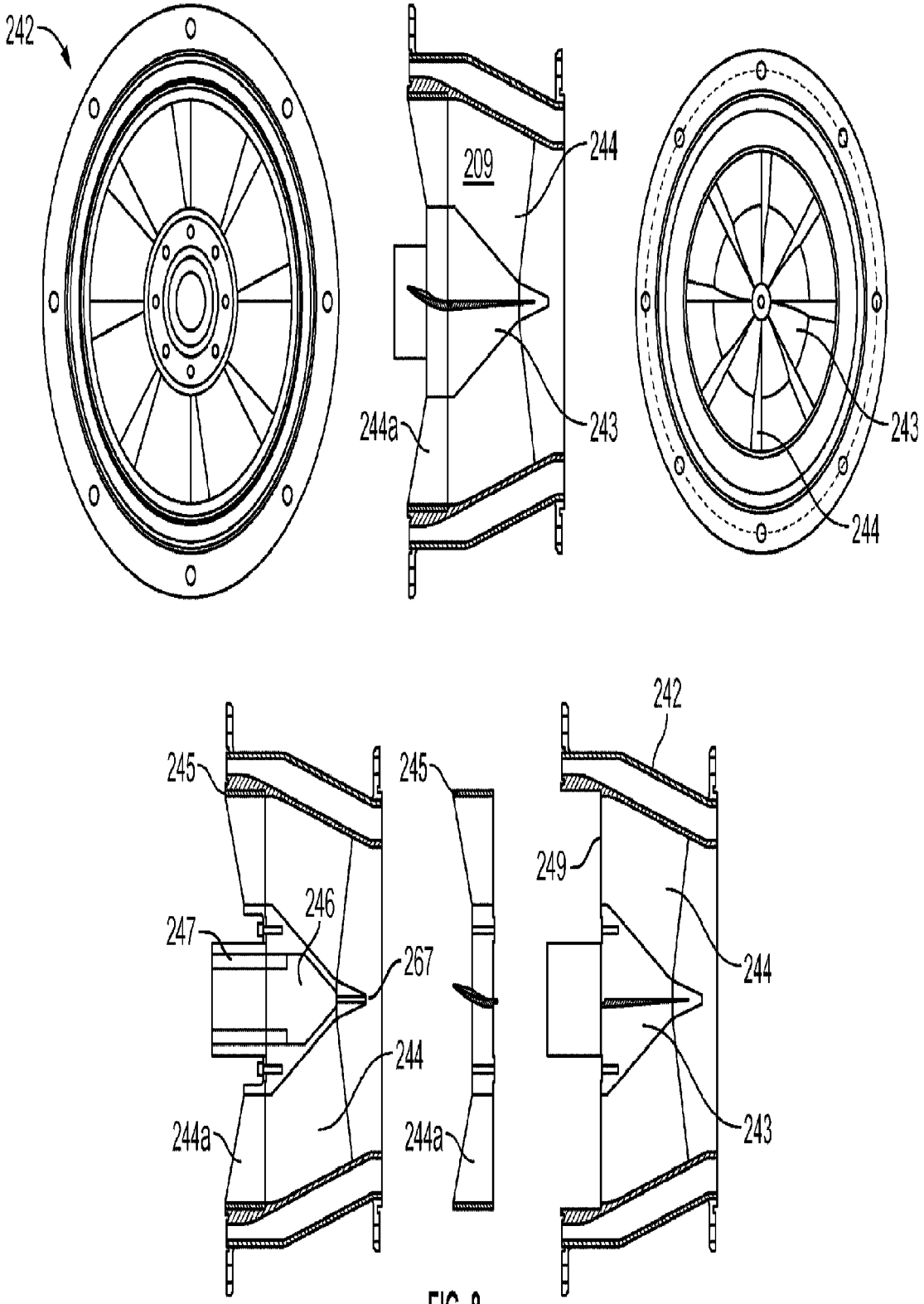
FIG. 8 is various views of a confusor/stator for a marine ducted propeller mass flux propulsion apparatus according to an exemplary embodiment of the present disclosure.

The confusor/stator hub 243, as shown in FIG. 8, preferably has an inwardly tapered convex surface and annular interior, oppositely disposed in relation to impeller hub 252. Confusor/stator hub 243 comprises a large flat diameter leading end, decreasing variable diameter mid-section and a small diameter trailing end forming a rounded nose with a concentric bore cavity 246 drilled through the middle thereof and a central annular end extension 530. Concentric outer annular cavity 246 is primarily for reduction of excess weight providing confusor/stator hub 243 with walls of substantially constant thickness. A concentric inner annular bore 246 defines a cylindrical housing for a support bearing for impeller shaft 204 supporting impeller 202. Bore 246 has a reduced diameter in the nose section of confusor/stator hub 243 as required by design strength criteria.

The confusor/stator blade design is typically based upon standard straight blade vane design except for significant changes incorporated into interchangeable blades 244*a* associated with the surface contour of confusor/stator 209. The interchangeable blade assembly 245 including interchangeable blades 244*a* have a radial width which is a function of a diameter of confusor/stator hub 243. The thickness of each stator vane 244 may be airfoil shaped or typically may have uniform thickness throughout except for an edge side which may be blunted or sharpened as design fine-tuning requires. Stator vanes 244 have a leading edge port 249 for accepting an interchangeable leading edge of interchangeable blades

244*a* which are curved in a direction opposite the directional advance of the impeller 202 and a straight section which is typically perpendicular to the hub surface, yet may also be inclined at an angle of up to about 10 degrees off an orthogonal plane bisecting the confusor/stator hub 243 at point of juncture and opposite the directional advance of the impeller 202 depending on performance fine-tuning. The curved end of the removable interchangeable blade assembly section 245 is typically inclined at an angle of about 10 to about 40 degrees off a longitudinal plane bisecting the confusor/stator hub 243 of the interchangeable blade assembly 245 and incorporating straight portion a section of generally uniform diameter tapered inwardly connecting stator vanes 244. The stator vanes 244 are securely affixed lengthwise on one end to the contour surface of confusor/stator hub 243 and on the other to the inside walls of housing and provide girding support for the bearing function of confusor/stator hub 243. The number of interchangeable blades 244*a* and stator vanes 244 is selected with respect to the number of impeller blades 250 in such a relation that the performance criteria of the confusor/stator 209 e.g. providing back-pressure, reduction of radial acceleration and rotational energy and turbulence while minimizing resonance and noise levels. In an important design feature, the ratio of impellers blades to confusor/stator blades and vanes is odd:even or vice versa. For example, given 3, 5, or 7 impeller blades the corresponding number of diffuser vanes would preferably be 6, 8, or 10.

Overall, the confusor/stator 209 is designed to control the shape of water flow and corresponding acceleration over a large pressure differential presented by a wide range of vessel speeds, maneuvers and sea conditions.

The impeller/confusor/stator section 200 is axially symmetrically disposed in the cylindrical impeller housing 251 with the confusor/stator housing 242 attached rearward of the impeller 202 in close proximity. The outer surface of the trailing end of impeller hub 252 is substantially parallel and continuous with the outside surface matching the outside surface of confusor/stator hub 243. Impeller/confusor/stator section 200 is so arranged to make this assembly simple and quick and to enable mating of the impeller 202 and confusor/stator 209 to prime mover 22 and craft design requirements. Impeller housing 251 may have a replaceable wear sleeve 260 enabling the diameter of housing to be reduced corresponding to reduction of impeller diameter. Thus a smaller diameter impeller arrangement can be used for smaller boats. There is, however, no limitation regarding horsepower or vessel size and propulsion system 10 may have proportionally expanded design capacity for large ships or for greater speeds.

Impeller shaft 204 extending axially through propulsion system 10 is provided with a first bearing support by interchangeable self-lubricating bearing assembly 30 mounted on impeller intake 205 and a second bearing support 247 at confusor/stator hub 243. Bearing assembly 30 includes housing, roller bearing and locking ring and lock nut. Bearing assembly 30 may also include a gear housing (not shown) for unit gearing to a particular prime mover requirement i.e. gas turbines.

Shaft 204 is provided with a shoulder 264 and a concentric distal section which has progressively smaller concentric diameter sections. Impeller 202 slides onto section of shaft 204 so that the annular end of leading edge on impeller hub 252 abuts shoulder 264 to present a smooth continuous surface for fluid flow. An annular locking sleeve 278 with a proximal annular end having greater diameter than a minimal diameter of the distal annular end extending outwardly from hub bore 266 engages the annular end holding impeller 202 securely against shoulder 264 on shaft 204. A locking ring 279 and locking nut 280 so secure the sleeve. Distal section of shaft 204 is threaded for locking nut so that standard key (not shown) and keyway combination synchronously engage impeller 202 upon shaft 204.

The bearing sleeve 247 is inserted into the center annular portion of confusor/stator hub 243. Assembly is completed by inserting the shaft portion having the sleeve 278 through the bearing 247 so that clearance between impeller hub 252 and confusor/stator hub 243 is about ⅛ inch. Bore 267 in the nose end of stationary confusor/stator hub 243 provides an exit for water flushing around the exterior of the bearing in hub bore 266. The bearing 247 is self-lubricating, self-cooling and self-flushing, typical of bearings used in marine applications.

An alternative bearing application for larger vessels is to set the bearing in the directional vanes and have the impeller positioned on the counter levered section of the shaft extending beyond the bearing housing positioned in a support stator.

The shaft 204 can also be housed in a shaft housing (not shown) of a foil shape to provide minimal drag resistance to the intake flow supported by directional vanes in front of the impeller forming a support structure. The mass of this housing designed into the flow characteristics of the impeller intake 205 can provide less drag resistance to the intake flow than the naked shaft as it stops the effects of the rotational velocities of the shaft pre-rotating or distorting the flow to the face of the impeller.

A means for joining impeller stator section casing to impeller intake housing 205 and an upper steering nozzle 401 to lower steering nozzle 402 comprises identical Victaulic style ring clamps or bolt flanges which are tightened by bolts within the clamp fitting over mated flanges affixed to respective sections. (In some implementations, a steering control housing attachment flange 294 can be used.) The clamp typically comprises two semicircular grooved pieces attached at a hinge. Additional joining means comprise matching flange connectors as between impeller housing 251 and confusor/stator housing 242 utilizing flanges with preferably a rubber seal, gasket or O-ring being utilized in between. Design of propulsion system 10 is such that the steering means 28 with a housing sits centrally atop pump housing section. Sections of housing are also joined by flanges.

An outlet or discharge section 400 extending from line C-C to line D-D comprises three cylindrical sections and provides three primary functions: containment and stabilizing of accelerated fluid from the confusor/stator 209, maintenance of steady-state flow to the efflux 499 and a means for swivelably directing the exiting stream to provide control means. Discharge section 400 incorporates complementary angles for upper steering nozzle 401 and lower steering nozzle 402 of preferably 60 degrees in order that a discharge point efflux 499 is horizontally aligned with bottom hull of craft 12.

The first section extending midway out from line C-C is angled cylindrical steering assembly 291. Discharge section 400 comprises a swivel able portion 293 which is swivel able horizontally through 360 degrees. Swivel able second section 293 and angled section are joined by bearing assembly 30. Bearing assembly 30 comprises inner race attached to the exterior surface of steering assembly 291, outer race attached to the exterior surface of section and bearing ring there between.

Steering device 28 links the steering column in a marine vessel to rotatable section of the mass efflux propulsion unit of the present invention. Steering linkage 26 comprises a steering rod having a sleeve bearing and a first and second universal joint. Second universal joint mounted atop a steering rod angularly extending through the interior of the steering assembly 291 is operatively associated with rotating section by means of spoke vanes 502. Spoke vanes 502 are designed and installed so as not to present an impediment to flow.

The third section of discharge section 400 is complementary angled housing clamped to section as mentioned previously and extending out to line D-D. Steering assembly 291 includes lower steering nozzle 402 and is designed to be interchangeable to enable performance guided selection of nozzle. The cross-sectional area of the steering assembly 291 in discharge section 400 is preferably proportional to the impeller inlet cross-sectional area at a ratio from about 0.25 to about 0.50:1. By adjusting the entry diameter of steering assembly 291 to accommodate the volumetric mass of the internal workings of the steering shaft, spoke vanes 502, flow guide vanes 503-505 and steering vane 403 in the flow volume, preferably at a ratio from about 0.30 to about 0.40:1 but optimally about 0.35:1, the interior surfaces of the lower steering nozzle 402 are smooth onto outlet cross-sectional area.

Lower steering nozzle 402 includes one or more flow guide vanes 503-505 preferably affixed perpendicularly to the inner surface of section. The flow guide vanes are designed to dampen flow rotation and turbulence and enable a steady laminar (steady-state) column of water throughput to be discharged from unit 10. In addition, lower steering nozzle 402 comprises a ring 505 attached to the outer edge of lower steering nozzle 402. The ring 505 artificially enhances the propulsive reaction of the water being discharged through the lower steering nozzle 402 by reducing boundary layer eddies around the edges of lower steering nozzle 402 exit lip to permit a smoother transition of the exiting water.

The internal flow characteristic of the upper steering nozzle 401 can accommodate the volumetric displacement of the steering shaft 501 by cross section by adjusting the shape of the upper steering nozzle 401. This can allow the transition of the flow off the back the back of the confusor/stator vanes 244 through the upper steering nozzle 401 to the lower steering nozzle 402 of the nozzle assembly to be without restriction and maintain the correct flow volume and velocities to the lower steering nozzle 402. Not doing so can create a change in the flow characteristic through the system resulting in turbulent flow with resulting back pressure changes. This can induce expediential pressure change in the flow to the upper steering nozzle 401 resulting in the creation of turbulent flow and back pressure changes affecting the efficiency of the confusor/stator 209 which will reduce overall system efficiency and eventual system failure. The increasing of the radius 248 and the length of the upper steering nozzle 401 reduces flow resistance and the changed increased transition radius of the confusor/stator 209 to upper steering nozzle 401 improves the efficiency of the flow through the upper steering nozzle 401. The increase in efficiency is directly related to the radial dimension and radial length of the elbow shape of the upper steering nozzle 401 and the improved internal flow velocities gained with the increase in transition radial length.

The internal flow characteristic of the steering assembly 291 can accommodate the volumetric displacement of the steering shaft 501 and spoke vanes 502 by cross section by adjusting the shape of the steering bearing assembly 291. This can allow the transition of the flow from the upper steering nozzle 401 through the bearing assembly to the lower steering nozzle 402 of the nozzle assembly to be without restriction and maintain the correct flow volume and velocities to the upper steering nozzle 401. Not doing so can create a flow drag in the flow characteristic through the system resulting in turbulent flow with resulting back pressure changes. This can induce expediential pressure change in the flow to the upper steering nozzle 401 and lower steering nozzle 402 resulting in the creation of turbulent flow and back pressure changes and a drop in efficiency.

The internal flow characteristic of the lower steering nozzle 402 can accommodate the volumetric displacement of flow guide vanes 503-505 by cross section by adjusting the shape of the lower nozzle. This can allow the transition of the flow from the bearing assembly to the lower nozzle exit point to be without restriction and maintain the correct flow volume and velocities to the lower steering nozzle 402. Not doing so can create a change in the flow characteristic through the system resulting in a drop in efficiency.

The lower steering nozzle 402 can be an interchangeable efflux nozzle with flow guide vanes 503-505 which can be carried up the length of the radius to incorporate the same radius as the exterior walls of the nozzle. The interchangeable efflux nozzle with flow guide vanes 503-505 positioned around an interior of the interchangeable efflux lower steering nozzle 402 enables controlling the water stream through a radius of the steering nozzle efflux and providing the required back pressure to ensure the flow in the lower steering nozzle 402 before it remains in steady state. This can provide a smoother transition for the guiding of the exiting transition of the flow through the radius of the lower steering nozzle 402 and reduces the creation of turbulence at the radius turn of the lower steering nozzle 402 improving flow through efficiency. The internal flow characteristic of the lower steering nozzle 402 can accommodate the flow guide vanes 503-505 by cross section adjustment to the shape of the lower steering nozzle 402 to ensure the flow through the lower steering nozzle 402 is steady state flow and uninhibited. As with the upper steering nozzle 401, increasing the radius of the lower steering nozzle 402 will reduce flow resistance and improve the efficiency of the flow through the lower steering nozzle 402. The increase in efficiency is directly related to the radial dimension and radial length of the elbow shape of the lower steering nozzle 402 and internal flow velocities. The interchangeability of the lower steering nozzle 402 with lower steering nozzles of shorter bend radii nozzles and the interchangeability of the upper steering nozzle 401 with shorter or longer bend radii nozzles allows for a height of the exiting solid stream to be adjustable. That is, by using nozzles of differing radius lengths lifts or lowers an efflux exit point 499 changing a thrust point and its effect on the vessel. The lower steering nozzle can have an entrance diameter to exit diameter ratio proportioned to a required volumetric velocity ratio adjustment needed to fine tune a required efflux and maintain steady state flow in the upper steering nozzle nozzles 401 and lower steering nozzle 402 before it.

The steering vane 403 in the lower steering nozzle 402 can aid in the tracking and better control of marine vessels with low angle dead rise hulls. The steering vane 403 will retract into the lower steering nozzle 402 if it encounters any obstacles in the water whether they are animal or mineral (i.e., floating debris or features of the marine environment).

The lower steering nozzle housing diameter accommodates the volumetric mass of the steering vane 403 in the flow volume by dimension.

Discharge section 400 also includes a bleeder hole 506 bored approximately in line with the end of confusor/stator hub 243 so that trapped air introduced into unit 10 may escape and unit 10 can be self-priming. The flow from the bleeder hole 506 can exit to the atmosphere or into the exhaust housing 600.

The control function of discharge section 400 is incorporated by the directing of nozzle thrust as provided by the steering apparatus 28. Directional headings are associated with operation of nozzle in position F (forward), R (reverse), and radial positions in between.

The reversing bumper 700 with rubber protector 701 can be designated to protect the steering nozzle assembly 409 from damage from ramming from the rear or when the vessel is reversing or is towing another vessel or object.

Figure 9:
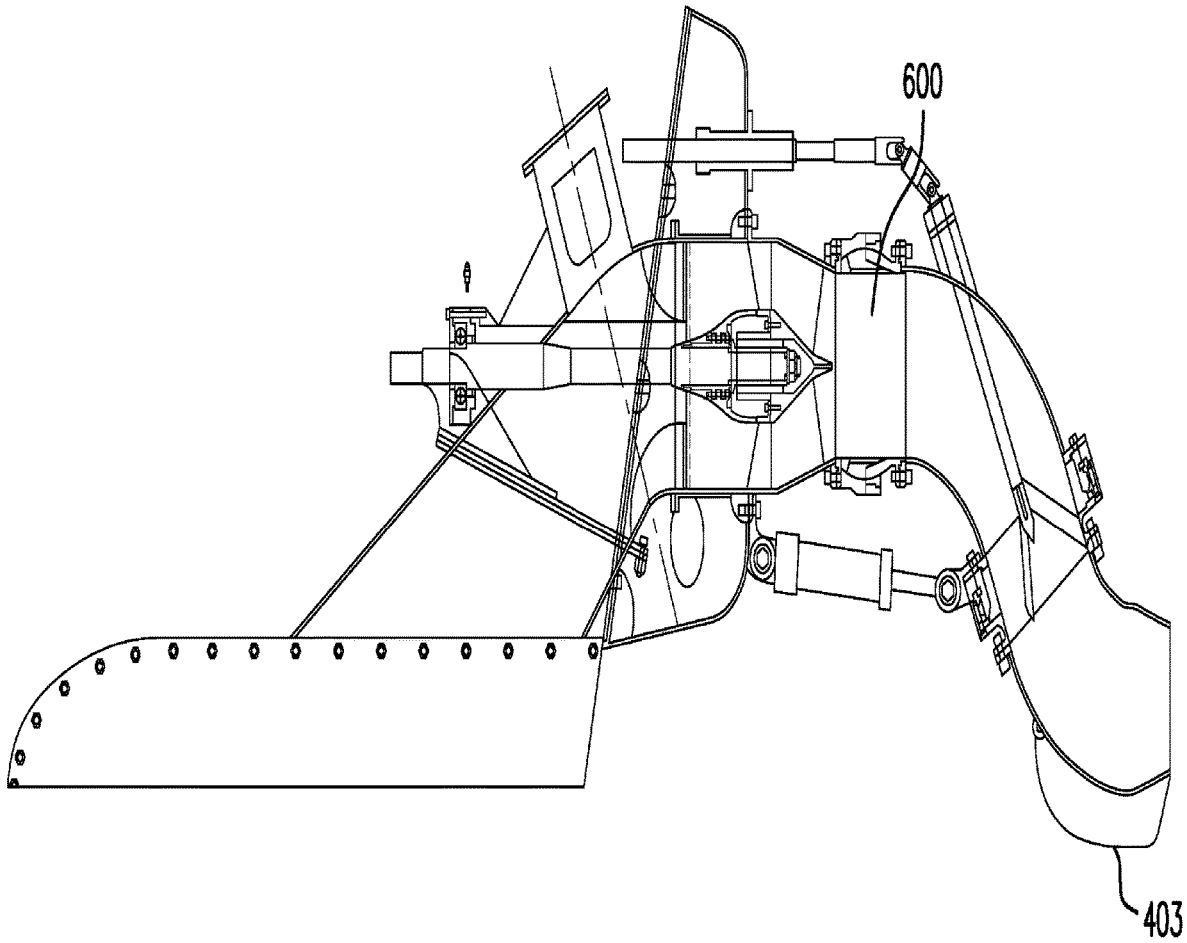
FIG. 9 is an illustration of a marine ducted propeller mass flux propulsion apparatus according to an exemplary embodiment of the present disclosure.
Figure 10:
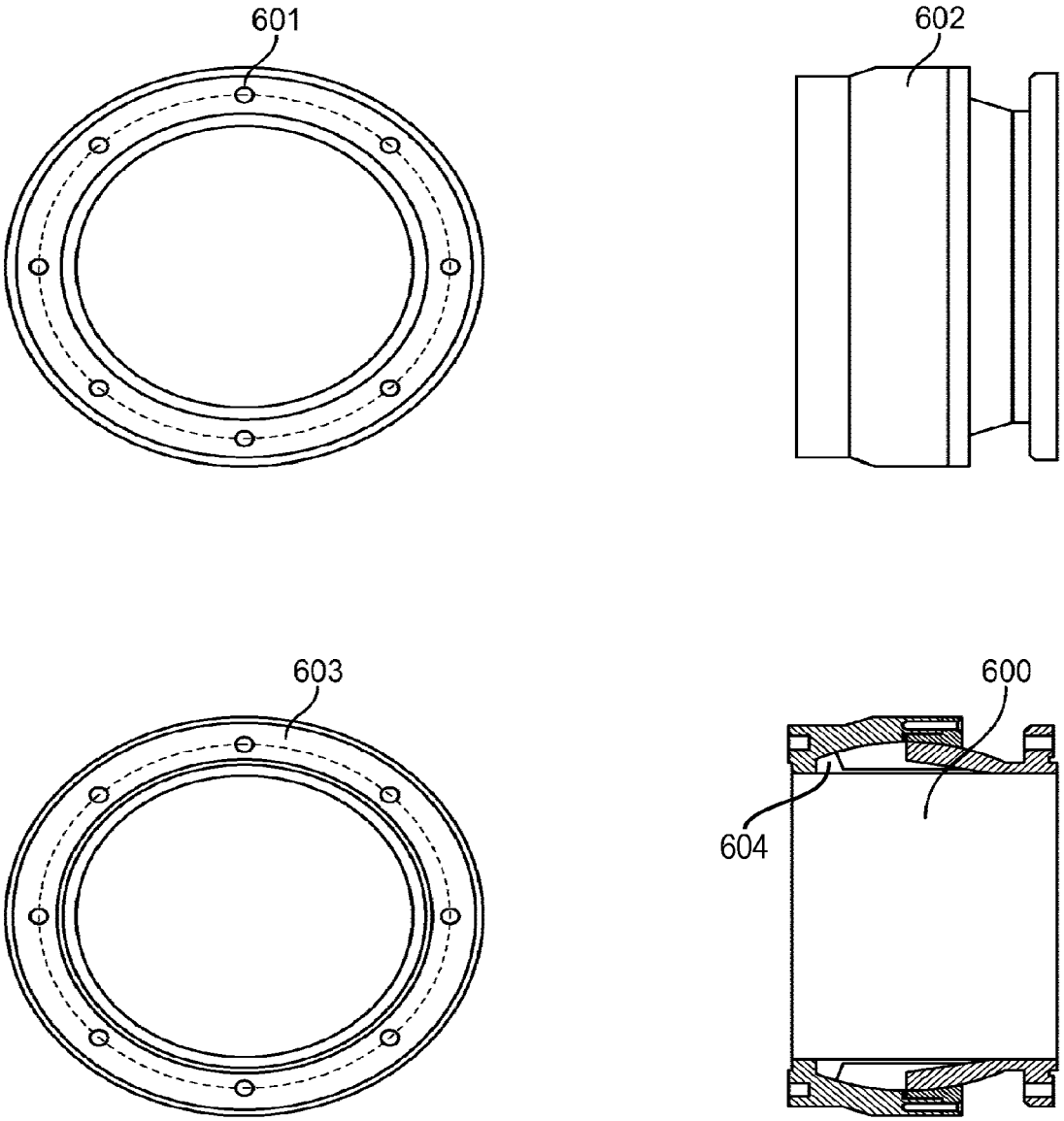
FIG. 10 is various views of trim for a marine ducted propeller mass flux propulsion apparatus according to an exemplary embodiment of the present disclosure.

The hydraulic trim 602, as seen in FIGS. 9 and 10, can allow an up or down trimming of a vessel while underway without unduly affecting the flow efficiency of the drive due to internal sleeve 604 designed to cover the workings of the trim and support flow continuum through the apparatus. The available trim 602 can permit an approximately 20 degrees change up or down in the positioning of the nozzle efflux. The internal flow characteristic of the hydraulic trim 602 can be parallel, and the entrance and exit flow velocities of the trim device can be as equal to each other as possible. The trim 602 can be included with or without the exhaust housing 600.

The marine mass flux propulsion unit 10 of the present invention is preferably fabricated and assembled from stainless steel chosen for its strength and resistance to corrosion properties, however, a non-corroding engineering aluminum, carbon fiber or plastic having good cohesive, impact and structural strength would also be suitable for one or more parts of the propulsion unit 10.

It will be appreciated that the performance of the marine mass flux propulsion system 10 is dependent upon the synergistic interrelation of the function of each individual section. Each individual section must be manufactured and assembled proportionally and symmetrically with consideration given to required pressure and flow balance needed to permit the mass flux propulsion unit 10 to function efficiently.

Predictability of performance in regards to the power requirements of the mass flux propulsion unit 10 (or a mass flux propulsion unit) enables the unit to be fine-tuned to a particular prime mover respecting design criteria of the lower intake 203, impeller intake 205, impeller housing 251 including impeller hub 252 and impeller blades 250, confusor/stator housing, confusor/stator hub 243, interchangeable blade assembly 245 including interchangeable blades 244*a* and stator vanes 244, steering nozzle assembly 400 including upper steering nozzle 401 and lower steering nozzle 402.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

The invention claimed is:

1. A marine ducted propeller jet propulsion apparatus comprising a propulsion system comprising:

an intake section;

an impeller section positioned downstream of the intake section;

the impeller section comprising an impeller housing, comprising an interchangeable blade assembly impeller, said interchangeable blade assembly impeller comprising an impeller hub and impeller blades, wherein the impeller blades are fixed along an outwardly tapered convex surface of the impeller hub, said interchangeable blade assembly impeller allowing a changing of each blade on the interchangeable blade assembly impeller if damaged, and allowing the changing of a pitch of the impeller blades for different applications, the impeller section comprising a diffuser/confusor housing, said diffuser/confusor housing comprising an interchangeable diffuser/confusor blade component, leading edge blades and diffuser vanes, said interchangeable diffuser/confusor blade component allowing changing of leading edge blades to the diffuser so to replace such leading edge blades if damaged, and allowing changing of a pitch of a leading edge of diffuser vanes to meet the needs of trailing edge velocities of the interchangeable blade assembly impeller;

a discharge section positioned downstream of the impeller section, the discharge section comprising a steering nozzle assembly;

a passage extending from an intake opening of the intake section formed in a bottom surface of a hull at one end to an outlet of the steering nozzle assembly at the other end; and a mass of at least a portion of one of a drive shaft, straightener intake flow guide vanes, pre-swirl stator vanes, the impeller housing, the impeller hub, impeller blades, the diffuser/confusor housing, a confusor/stator hub, the interchangeable blade assembly impeller, a steering shaft, spoke vanes, and flow guide vanes, being accommodated within the passage;

wherein the passage has an axial cross-sectional area, the axial cross-sectional area of the passage being adjusted throughout the passage by increasing external dimensions accordingly and/or by increasing a radius of the axial cross-sectional area to accommodate for a volumetric mass of the at least a portion of one of a drive shaft, straightener intake flow guide vanes, pre-swirl stator vanes, the impeller housing, the impeller hub, impeller blades, the diffuser/confusor housing, a confusor/stator hub, the interchangeable blade assembly impeller, a steering shaft, spoke vanes, and flow guide vanes so that the passage is capable of converging a passing water mass on a volumetric basis while maintaining a solid state character of the passing water mass as the passing water mass is driven through the passage from the intake opening of the intake section to the outlet of the steering nozzle assembly; and wherein the axial cross-sectional area substantially and regularly decreases from an inlet to the outlet of the steering nozzle assembly without resistance of the mass of the at least a portion of one of a drive shaft, straightener intake flow guide vanes, pre-swirl stator vanes, the impeller housing, the impeller hub, impeller blades, the diffuser/confusor housing, a confusor/stator hub, the interchangeable blade assembly impeller, a steering shaft, spoke vanes, and flow guide vanes, representing a restriction or obstruction to a flow of the passing water mass.

2. A marine ducted propeller mass flux propulsion system comprising:

an intake section;

an impeller/confusor/stator section;

a discharge section;

a passage extending from an intake opening of the intake section to an outlet of the discharge section, the passage having a length and an axial cross-sectional area, the passage capable of creating a flow path for a water stream on a volumetric basis, the passage being shaped to accelerate the water stream through the passage as the water stream is driven through the passage by a prime mover;

at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes, at least partially accommodated within the passage;

wherein the axial cross-sectional area of the passage is increased and decreased throughout the length of the passage to accommodate a volumetric mass of the at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes while maintaining a constant accelerating water volume from the intake opening of the intake section to the outlet of the discharge section so that the water stream maintains a steady-state flow volume through the passage; and wherein the confusor/stator and the discharge section form an exit radius at a transition point between the confusor/stator and the discharge section which allows for a reduction of turbulent flow for the water stream.

3. A marine ducted propeller mass flux propulsion system comprising:

an intake section;

an impeller/confusor/stator section;

a discharge section;

a passage extending from an intake opening of the intake section to an outlet of the discharge section, the passage having a length and an axial cross-sectional area, the passage capable of creating a flow path for a water stream on a volumetric basis, the passage being shaped to accelerate the water stream through the passage as the water stream is driven through the passage by a prime mover;

at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes at least partially accommodated within the passage;

an exhaust heat exchanger;

a confusor/stator housing;

an upper steering nozzle; and a lower steering nozzle, wherein the exhaust heat exchanger heats the confusor/stator housing, the upper steering nozzle and the lower steering nozzle; and wherein the axial cross-sectional area of the passage is increased and decreased throughout the length of the passage to accommodate a volumetric mass of at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes while maintaining a constant accelerating water volume from the intake opening of the intake section to the outlet of the discharge section so that the water stream maintains a steady-state flow volume through the passage.

4. The marine ducted propeller mass flux propulsion system as claimed in claim 3, further comprising:

a lower steering nozzle, the lower steering nozzle being interchangeable.

5. A marine ducted propeller mass flux propulsion system comprising:

an intake section;

an impeller/confusor/stator section;

a discharge section;

a passage extending from an intake opening of the intake section to an outlet of the discharge section, the passage having a length and an axial cross-sectional area, the passage capable of creating a flow path for a water stream on a volumetric basis, the passage being shaped to accelerate the water stream through the passage as the water stream is driven through the passage by a prime mover;

at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes being at least partially accommodated within the passage;

straightener intake flow guide vanes, the straightener intake flow guide vanes being positioned in front of an impeller, the straightener intake flow guide vanes directing the water stream from the intake opening to a face of an impeller; and wherein the axial cross-sectional area of the passage is increased and decreased throughout the length of the passage to accommodate a volumetric mass of the at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes while maintaining a constant accelerating water volume from the intake opening of the intake section to the outlet of the discharge section so that the water stream maintains a steady-state flow volume through the passage.

6. A marine ducted propeller mass flux propulsion system comprising:

an intake section;

an impeller/confusor/stator section;

a discharge section;

a passage extending from an intake opening of the intake section to an outlet of the discharge section, the passage having a length and an axial cross-sectional area, the passage capable of creating a flow path for a water stream on a volumetric basis, the passage being shaped to accelerate the water stream through the passage as the water stream is driven through the passage by a prime mover;

at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes being at least partially accommodated within the passage;

an upper steering nozzle; and a lower steering nozzle, wherein the lower steering nozzle is removably attached to an end of the upper steering nozzle; and wherein the axial cross-sectional area of the passage is increased and decreased throughout the length of the passage to accommodate a volumetric mass of the at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes while maintaining a constant accelerating water volume from the intake opening of the intake section to the outlet of the discharge section so that the water stream maintains a steady-state flow volume through the passage.

7. The marine ducted propeller mass flux propulsion system as claimed in claim 6, further comprising: stator vanes, the stator vanes being positioned around an interior of the lower steering nozzle thereby controlling a water stream through a radius of the lower steering nozzle.

8. A marine ducted propeller mass flux propulsion system comprising:

an intake section;

an impeller/confusor/stator section;

a discharge section;

a passage extending from an intake opening of the intake section to an outlet of the discharge section, the passage having a length and an axial cross-sectional area, the passage capable of creating a flow path for a water stream on a volumetric basis, the passage being shaped to accelerate the water stream through the passage as the water stream is driven through the passage by a prime mover;

at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes being at least partially accommodated within the passage;

an upper steering nozzle; and a lower steering nozzle, the upper steering nozzle and the lower steering nozzle being interchangeable to permit a change in height of an efflux of the lower steering nozzle and to accommodate an alignment of the efflux with a hull of a marine craft thereby increasing propulsion efficiency; and wherein the axial cross-sectional area of the passage is increased and decreased throughout the length of the passage to accommodate a volumetric mass of the at least a portion of one of a drive shaft, straightener intake flow guide vanes, pre-swirl stator vanes, an impeller housing, an impeller hub, impeller blades, a diffuser/confusor housing, a confusor/stator hub, an interchangeable blade assembly impeller, a steering shaft, spoke vanes, and flow guide vanes while maintaining a constant accelerating water volume from the intake opening of the intake section to the outlet of the discharge section so that the water stream maintains a steady-state flow volume through the passage.

9. The marine ducted propeller jet propulsion apparatus as claimed in claim 1, comprising an impeller intake wherein a cross-sectional area of intake is adjusted to include a volumetric insertion in the flow of a mass of a drive shaft, straightener vanes and directional or pre-swirl vanes by increasing external dimensions of the axial cross-sectional area accordingly.

10. The marine ducted propeller jet propulsion apparatus as claimed in claim 1, wherein the steering nozzle assembly comprises an upper nozzle and a lower nozzle and wherein a radius of the upper nozzle is increased to reduce flow resistance.

11. The marine ducted propeller jet propulsion apparatus as claimed in claim 1, wherein the steering nozzle assembly comprises an upper nozzle and a lower nozzle and wherein the radius of the lower nozzle is increased to reduce flow resistance.

12. The marine ducted propeller jet propulsion apparatus as claimed in claim 1, further comprising:

an increased exit radius, the increased exit radius being introduced at a transition point between the diffuser/confusor housing and an upper steering nozzle of a steering nozzle assembly thereby allowing for a less angular transition from the diffuser/confusor housing to an upper portion of the steering nozzle.

13. The marine ducted propeller propulsion apparatus as claimed in claim 1, wherein a lower steering nozzle of a steering nozzle assembly is interchangeable to enable adjustments to the steering nozzle.

14. The marine ducted propeller propulsion apparatus as claimed in claim 13, wherein the lower steering nozzle is removably attached to an end of an upper steering nozzle.

15. The marine ducted propeller propulsion apparatus as claimed in claim 14, further comprising:

straightener vanes, the straightener vanes being affixed perpendicularly to the inner surface of the lower steering nozzle to dampen swirl and enable a steady laminar column of water throughput to be discharged.

16. The marine ducted propeller jet propulsion apparatus as claimed in claim 1, comprising a hydraulic trim, incorporating hydraulic ball joint components, for up or down trimming of a vessel while underway without unduly affecting a flow efficiency of a drive.

17. The marine ducted propeller jet propulsion apparatus as claimed in claim 1, wherein the intake section defines an intake passage in an inlet housing communicating between the intake opening at one end and an impeller intake to the impeller section at an other end, wherein a bypass valve assembly is fitted in the inlet housing near an inlet, the bypass valve being set to a desired pressure release by pressure sensors attached to a side of the inlet housing.

* * * * *